United States Patent [19]

Wellman et al.

[11] Patent Number: 4,549,601

[45] Date of Patent: Oct. 29, 1985

[54] VARIABLE VOLUME MULTIZONE SYSTEM

[75] Inventors: Donald C. Wellman, Marcellus; William E. Clark, Syracuse, both of N.Y.

[73] Assignee: Carrier Corporation, Syracuse, N.Y.

[21] Appl. No.: 562,912

[22] Filed: Dec. 19, 1983

Related U.S. Application Data

[63] Continuation-in-part of Ser. No. 390,606, Jun. 21, 1982, Pat. No. 4,495,986.

[51] Int. Cl.[4] ..... F25B 29/00

[52] U.S. Cl. ..... 165/2; 165/16; 165/22; 165/48; 165/26; 165/27; 165/48.1; 98/39.1; 236/1 B; 236/49; 236/91 D

[58] Field of Search ..... 165/2, 16, 22, 26, 27, 165/34, 35, 100, 101, 48, 50; 98/38.7, 39; 236/1 B, 1 C, 9 R, 9 A, 91 D, 91 E, 91 C, 49

[56] References Cited

U.S. PATENT DOCUMENTS

| | | | |
|---|---|---|---|
| 2,372,839 | 3/1945 | McGrath | 165/16 |
| 2,806,675 | 9/1957 | Conradi | 165/50 |
| 2,885,187 | 5/1959 | Myck, Jr. | 236/1 B |
| 3,324,782 | 6/1967 | Norris et al. | 165/48 |
| 3,429,367 | 2/1969 | McGrath | 165/48 |
| 3,901,310 | 8/1975 | Strawn | 165/50 |
| 3,927,713 | 12/1975 | Gilles | 165/16 |
| 3,934,795 | 1/1976 | Ginn et al. | 165/27 |
| 4,044,947 | 8/1977 | Spethmann | 165/16 |
| 4,157,112 | 6/1979 | Swiderski | 165/50 |
| 4,182,484 | 1/1980 | Stanke et al. | 165/26 |
| 4,203,485 | 5/1980 | Zilbermann et al. | 165/2 |
| 4,294,403 | 10/1981 | Ammons et al. | 165/27 |

FOREIGN PATENT DOCUMENTS

| | | | |
|---|---|---|---|
| 457313 | 6/1949 | Canada | 165/22 |
| 2810033 | 10/1978 | Fed. Rep. of Germany | 165/22 |
| 86642 | 12/1955 | Norway | 236/1 B |

*Primary Examiner*—Albert W. Davis, Jr.
*Attorney, Agent, or Firm*—David J. Zobkiw

[57] ABSTRACT

A zoned variable volume system is provided with a pair of non-connected dampers in each zone. The first damper controls flow through a cooling coil. The second damper controls flow through a heating coil and provides heated or neutral air depending upon whether or not the heating coil is actuated. The fan speed is adjusted to cause at least one damper to be fully open so that the system operates at a minimum static pressure.

7 Claims, 14 Drawing Figures

VARIABLE VOLUME MULTIZONE SYSTEM

This application is a continuation-in-part of application Ser. No. 390,606 filed June 21, 1982 and commonly assigned now U.S. Pat. No. 4,495,986 granted Jan. 29, 1985.

BACKGROUND OF THE INVENTION

In large buildings, such as office buildings, the core of the building is generally isolated from external environmental conditions. As a result, the core of a building is usually cooled year-round due to the heating load of the lights, machinery and personnel while the periphery of the building is heated or cooled, as required. Thus, in such buildings, there is ordinarily a concurrent demand for cooling and heating and/or neutral air to provide temperature regulation and to overcome air stagnation.

Various configurations have been employed to meet the differing demands of different parts of the system. In constant volume systems, a constant delivery fan is used and the dampers are linked together to provide a constant air flow with the character/temperature of the flow being thermostatically controlled. In variable volume systems, many means are used to control fan volume. The fan speed of a variable speed fan can be varied to maintain static pressure requirements while the individually controlled dampers regulate the flow in each zone. Other means of control are riding the fan curve, using inlet guide vanes and using discharge dampers. Minimum airflow is usually maintained in a variable volume air system, but in such systems the dampers are remotely located from the air handler. Additionally, in conventional variable volume systems, only cooled or neutral air is circulated in the system. At locations where heating is required, a local heat source, such as an electric resistance heater, is provided. The air to be heated is provided from a separate source, such as the ceiling plenum, and requires additional fans.

SUMMARY OF THE INVENTION

The present invention is directed to a variable air volume, zoned blow through unit with integrally packaged microprocessor based controls. It is a total air conditioning system which provides controlled volumetric air flow of heated, neutral, or cooled air to the various zones to regulate the conditioned space environmental conditions. Neutral air is a mixture of return air and fresh outside air provided at the intake of the air conditioning unit. Space environmental conditions are maintained by air volume control to the zones and not by the mixing of hot deck and cold deck air. Neutral air is supplied to a zone in the dead band between the heating and cooling modes for fresh air and ventilation.

Each zone has a pair of independent, non-linked air dampers, a cooling damper and a neutral/heating damper, and individual zone heat coils. The individual dampers are controlled by a single set of sensors, a space temperature sensor and a zone velocity sensor, through a microprocessor control. As space conditions change from cooling mode to dead band, to heating mode, or vice versa, damper control of air flow is shifted from the cooling damper to the neutral/heating damper. A control lock-out is provided to prevent mixing of hot and cold deck air.

The system may be operated with a constant speed centrifugal fan with the system "riding" the pressure-volume performance curve. Maximum volumetric air flow for each zone is input to the microprocessor control for cooling mode, neutral mode, and heating mode. The operating mode is determined by space temperature and set points input to the microprocessor control.

As a result of these inputs and control loops, the zone dampers are modulated by the controller during equipment operation to obtain the required air volume in each zone. The result is an automatic system balancing of the various zone air distribution ducts.

In operation with a constant speed centrifugal fan and the system "riding" the fan pressure-volume performance curve, the excess fan static pressure produced by the fan is neutralized by further closure of a zone damper resulting in added control damper air flow resistance. Often in operation, however, energy will be saved by the use of a fan speed control device or fan inlet guide vane for fan pressure-volume control. Variable frequency motors and variable pitch pulleys are suitable for these purposes. The conventional fan pressure-volume control is obtained by measuring and maintaining a duct system static pressure at some point in the duct system. This requires a detailed knowledge of the duct system up to the optimum sensor location. However, the optimum sensor location continually changes with flow requirements in the various zones. The fan control used in this invention involves input data from the zone damper control loop and damper position data for fan speed or inlet guide vane pressure volume control. As a result the fan and system is always operated at the optimum, the lowest possible fan pressure-volume operating point.

It is an object of this invention to provide a method and apparatus for operating a variable volume multizone air conditioner at the lowest speed or power energy sufficient for operation.

It is another object of this invention to provide a method and apparatus for automatically balancing the system.

It is a further object of this invention to provide a method and apparatus for operating the dampers of each zone in each mode of operation. These objects, and others as will become apparent hereinafter, are accomplished by the present invention.

Basically, a variable speed fan is used to supply air to a multizone unit where the flow is divided and supplied to each zone through the appropriate coil and damper. The dampers in each zone are regulated such that heated and cooled air cannot be supplied simultaneously to a zone. Also, the open damper in each zone is positioned to control flow in the zone in accordance with thermostatic demand and, usually, minimum air flow requirements. The position of the open damper in each zone is monitored and the fan speed is regulated so as to have all of the zones satisfied and the damper in at least one zone fully open.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
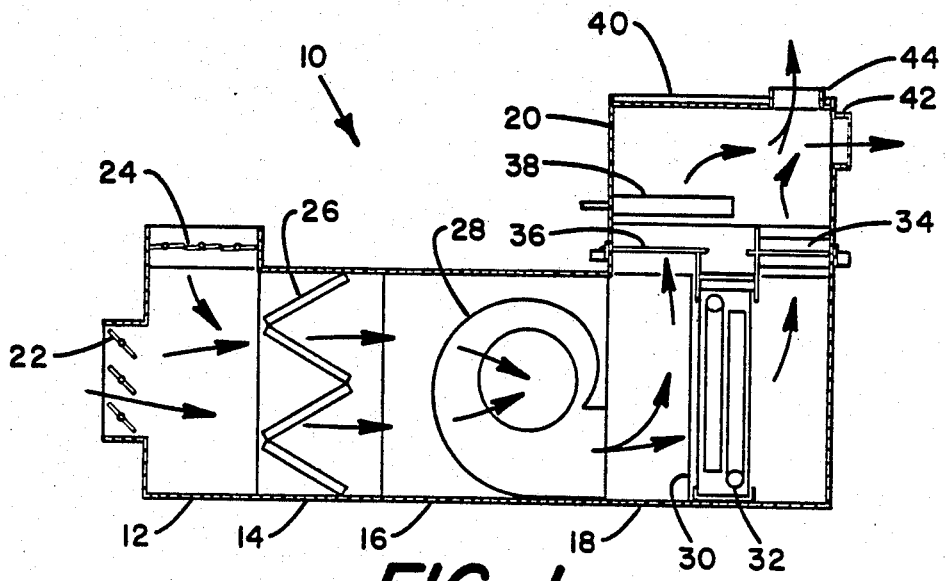
FIG. 1 is a simplified sectional view of a portion of the air distribution structure of the present invention.
Figure 3A:
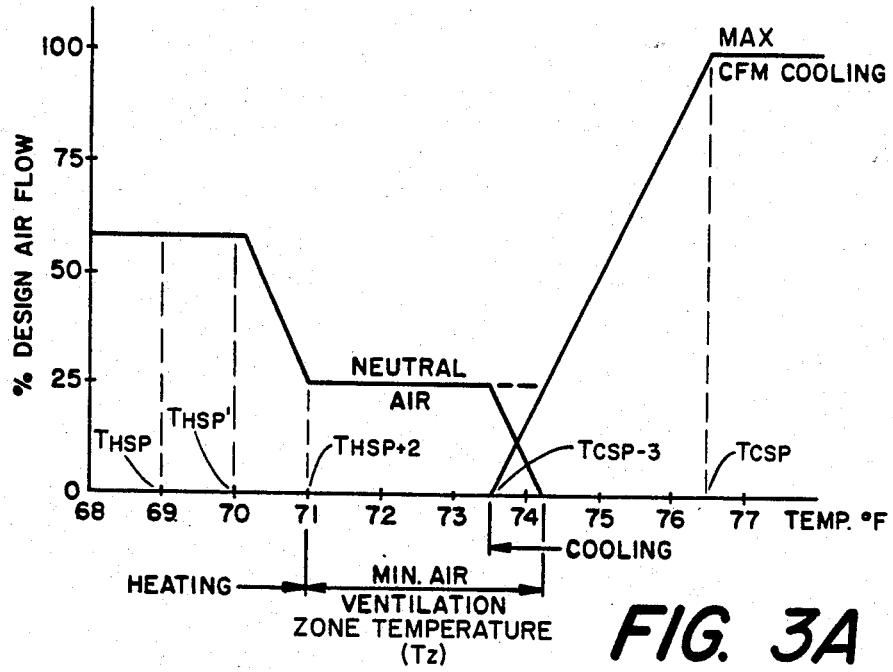
FIG. 3A is a graph showing a typical control sequence where a constant volume heating mode is employed.
Figure 2:
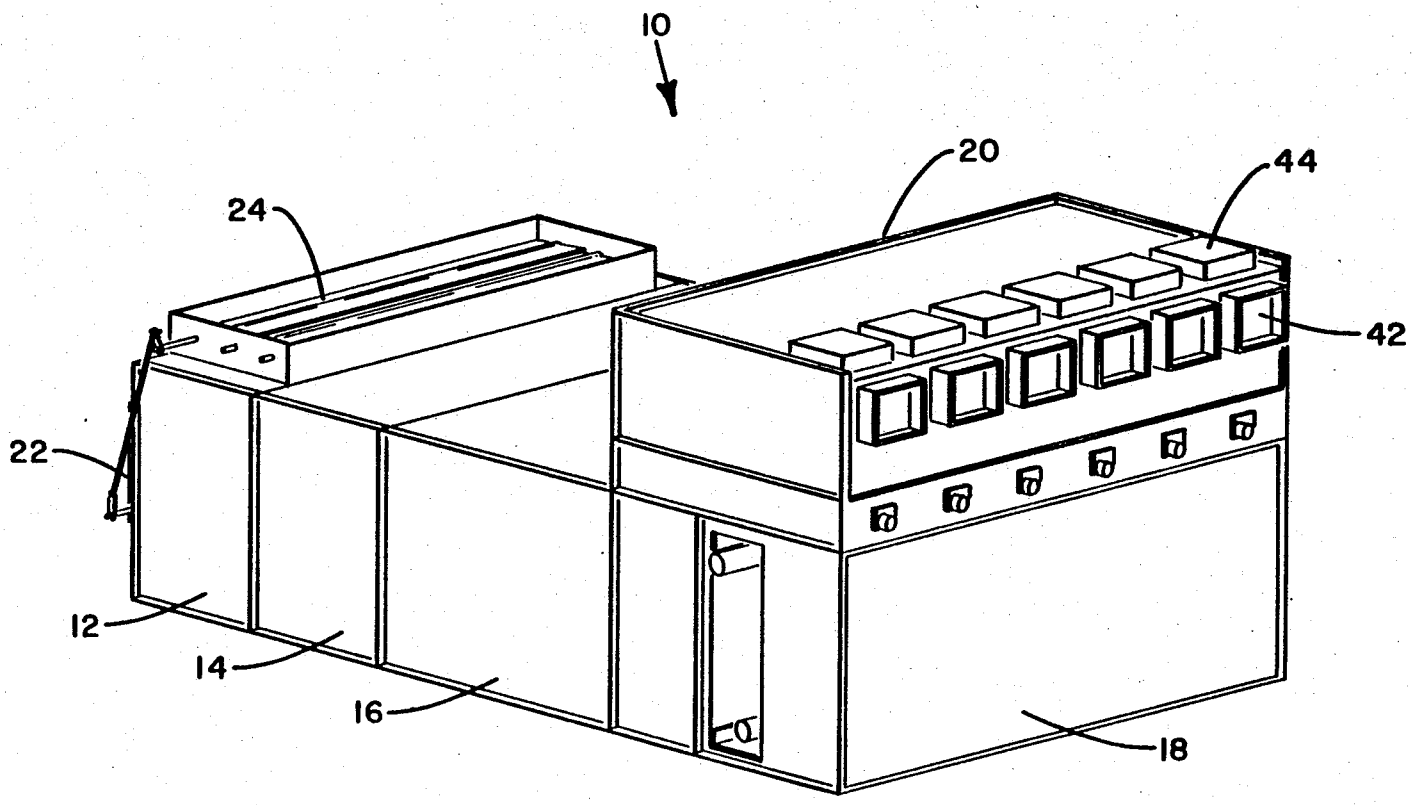
FIG. 2 is a pictorial view of the FIG. 1 device.

In FIGS. 1 and 2, the numeral 10 generally designates a variable volume multizone unit with just one zone supply being illustrated in FIG. 1. The variable volume multizone unit 10 is made up of mixing box 12, low velocity filter section 14, fan section 16, blow through coil section 18 and variable multizone section 20. The mixing box 12 is supplied with outside air or a return and outside air mixture via linked mixing box dampers 22 and 24, respectively. The outside air or return and outside air mixture is supplied to mixing box 12, passes through filter 26 in low velocity filter section 14 and is supplied to the inlet of variable speed fan 28. Fan 28 supplies air to the blow through coil section 18 in amounts determined by the speed of fan 28 and, up to this point, the flow path and structure only differs from that which is conventional for a VAV system in that it is a blow-through rather than a draw-through arrangement. Also, unlike a conventional VAV system, air passing from the blow through coil section 18 is divided for supply to the respective zones after passing through a zone section or unit 40 of variable multizone section 20. More specifically, air supplied by fan 28 to blow through coil section 18 passes into the zone sections 40 of variable multizone section 20 by either, or both, of two routes. The first route is through perforated plate 30 which provides good air distribution across the coil 32 when air is flowing through damper 34 but prevents cooling coil wiping by air flowing through damper 36. The flow then passes through chilled water coil 32 where the flow divides and passes through dampers 34 which respectively control the supply of cooling air to each zone. The second route into the zone sections 40 of multizone section 20 is via dampers 36 which respectively control the supply of neutral air to each zone. A zone hot water or electric heat coil 38 is located downstream of each damper 36 to prevent heating coil wiping and, when activated, heats the neutral air to supply warm air to the zone. The cool, neutral or warm air passes from each zone section or unit 40 by way of either a horizontal discharge 42 or a vertical discharge 44, as required, with the other discharge being blocked. Referring now to FIGS. 3A and B, it will be seen that there is a neutral air region during which there is a preselected minimum air circulation of neutral air, generally about 25% of full flow, to prevent stagnation, but no heating or cooling of the air supplied to the zone takes place except for the area of overlap between the minimum air ventilation and cooling ranges. During passage through this overlapping range, control passes between the cool and neutral air dampers, depending upon the direction of temperature change, and air is supplied through each damper with the total amount being the minimum air. The changeover between heated and neutral air is simply a matter of activating or deactivating the heating source. This 2° or 3° F. range of neutral air prevents the blending of heated and cooled air as well as cycling since the heating or cooling is shut off at the extremes of this temperature range and there is a significant time period required for the zone to pass through the neutral air region. Additionally, this avoids the problem of dead band where there is no air motion when system temperature requirements are satisfied. In FIGS. 3A and B the dead band would be the temperature range between the intersections of the sloped heating and cooling lines and the horizontal axis.

The volumetric flow of air required in the heating mode ranges from approximately 50% to 100% of the maximum cooling flow. The maximum volumetric heating flow requirements depends upon the type of zone heating used and design conditions. Generally, constant volume heating is applied at approximately 50% of maximum cooling flow when high temperature hot water or electric heat is used. Variable volume heating at maximum flows equal to maximum cooling flow is applied with low temperature hot water heating such as from heat pumps or heat recovery. At application, the control is configured for operation with the heating mode selected.

In FIG. 3A which illustrates the constant volume heating mode, Tcsp is the cooling set point and Thsp and Thsp′ represent the heating set points at which the heating coils are turned on and off respectively. If there is staged heating, it is enabled at intermediate points. As the temperature drops below Thsp+2, volume flow of neutral air increases until the desired heating volume flow, of say 50%, is reached. The initial increase of neutral air may preclude the need for the heating coil being employed. This is because the use of return air from the interior zones may supply sufficient heat for the perimeter zones. The heating coil is activated and deactivated in the constant volume flow range to maintain Thsp. Thsp and Thsp′ are separated to prevent unnecessary cycling since if a temperature were sought to be maintained exactly, the coil would go on and off as the single point is reached and left. Also, the coil contains residual heat so that it continues to supply heat for a short while after it is shut off. It will be noted that there are horizontal or constant flow lines in each mode with sloped lines providing the variable volume transitions. For any temperature of Tcsp, or above, the cooling flow will be constant, 100% of the cooling flow set point. For any temperature below Thsp′, the heating flow will be constant at the maximum heat flow set point. Between Tcsp and some temperature 2 or 3 degrees lower, such as Tcsp-3, the cooling flow is varied from 100% to 0%.

Figure 3B:
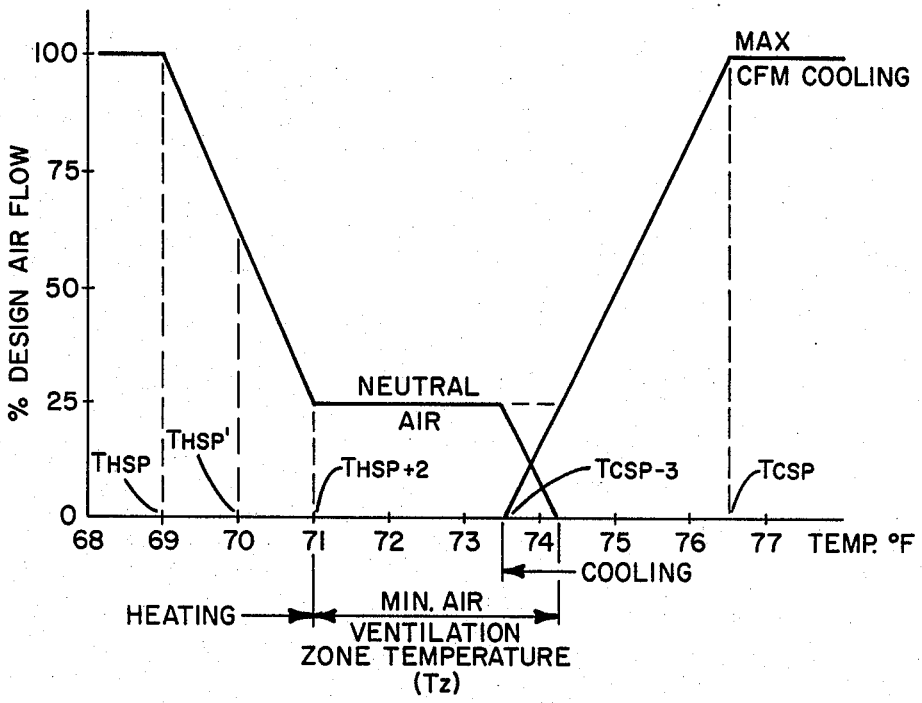
FIG. 3B is a graph showing a typical control sequence where a variable volume heating mode is employed.

FIG. 3B represents the temperature flow mode diagram for variable volume heat control. The heat source is low temperature hot water and the heating coil is activated in the variable air flow area at Thsp′ which is at a higher temperature than Thsp. Heat output is increased from the low and relatively constant temperature heat source by increasing the flow up to 100%. Except that heating starts at Thsp' and the heat flow is flow volume related, FIG. 3B is otherwise the same as FIG. 3A.

To meet minimum air ventilation requirements, over the range of overlap between cooling and minimum air ventilation, neutral air is supplied in addition to the cool air to produce a combined minimum flow which is typically 25% of maximum air flow. From Tcsp-3 down to a temperature 2 or 3 degrees higher than Thsp, i.e. Thsp+2 in FIGS. 3A and B, only neutral air is supplied and in minimum flow amounts.

Figure 4:
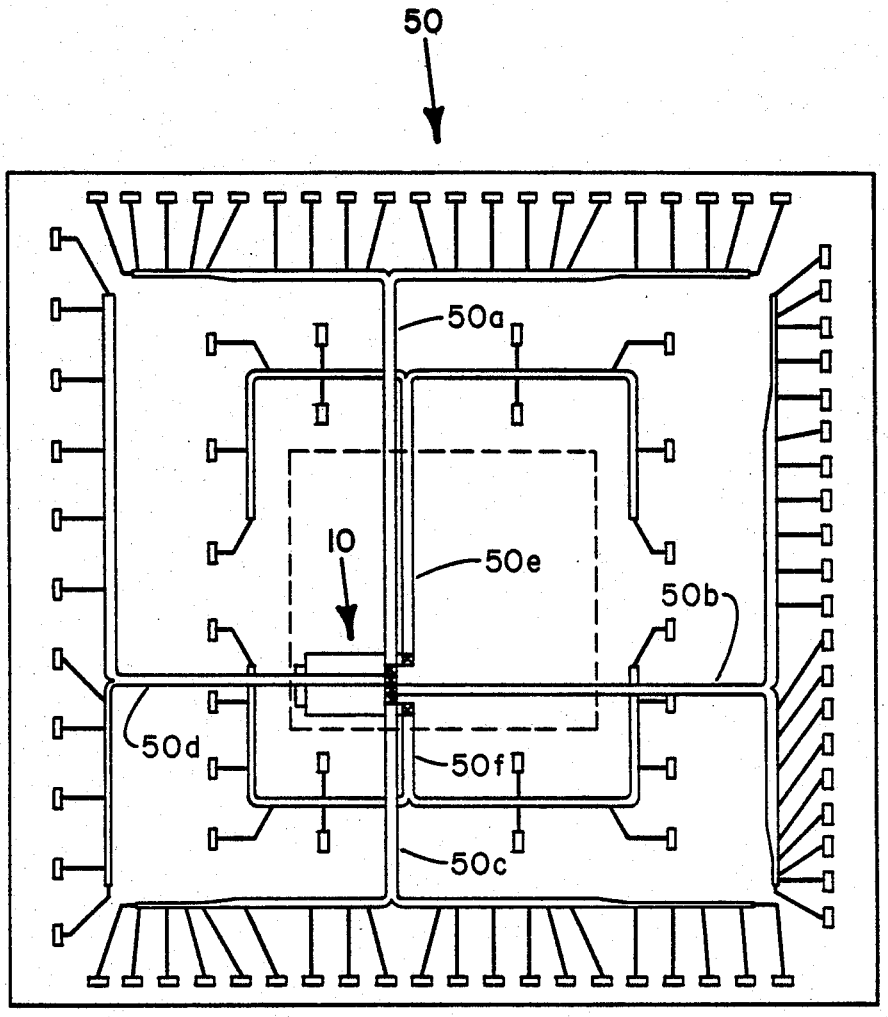
FIG. 4 is a schematic representation of an air distribution system using the present invention.

FIG. 4 illustrates a six zone distribution system 50 employing the teachings of the present invention. The variable volume multizone unit 10 supplies four perimeter zones via ducts 50*a, b, c* and *d*, respectively, and two interior zones via ducts 50*e* and *f*, respectively. As will be explained in detail hereinafter, the system 50 is under the control of a computer which would receive temperature data from each zone and velocity/volume signal data from each zone supply to thereby control the dampers 34 and 36 for each zone responsive thereto to regulate the amount of air and the temperature of the air supplied to each zone. If there is a heating demand in any zone, the hot water or electric heat coil 38 is activated in that zone as by opening a valve in the case of a hot water coil or supplying electric power in the case of an electric coil. The speed of fan 28 would be controlled in response to the load requirements.

Figure 5:
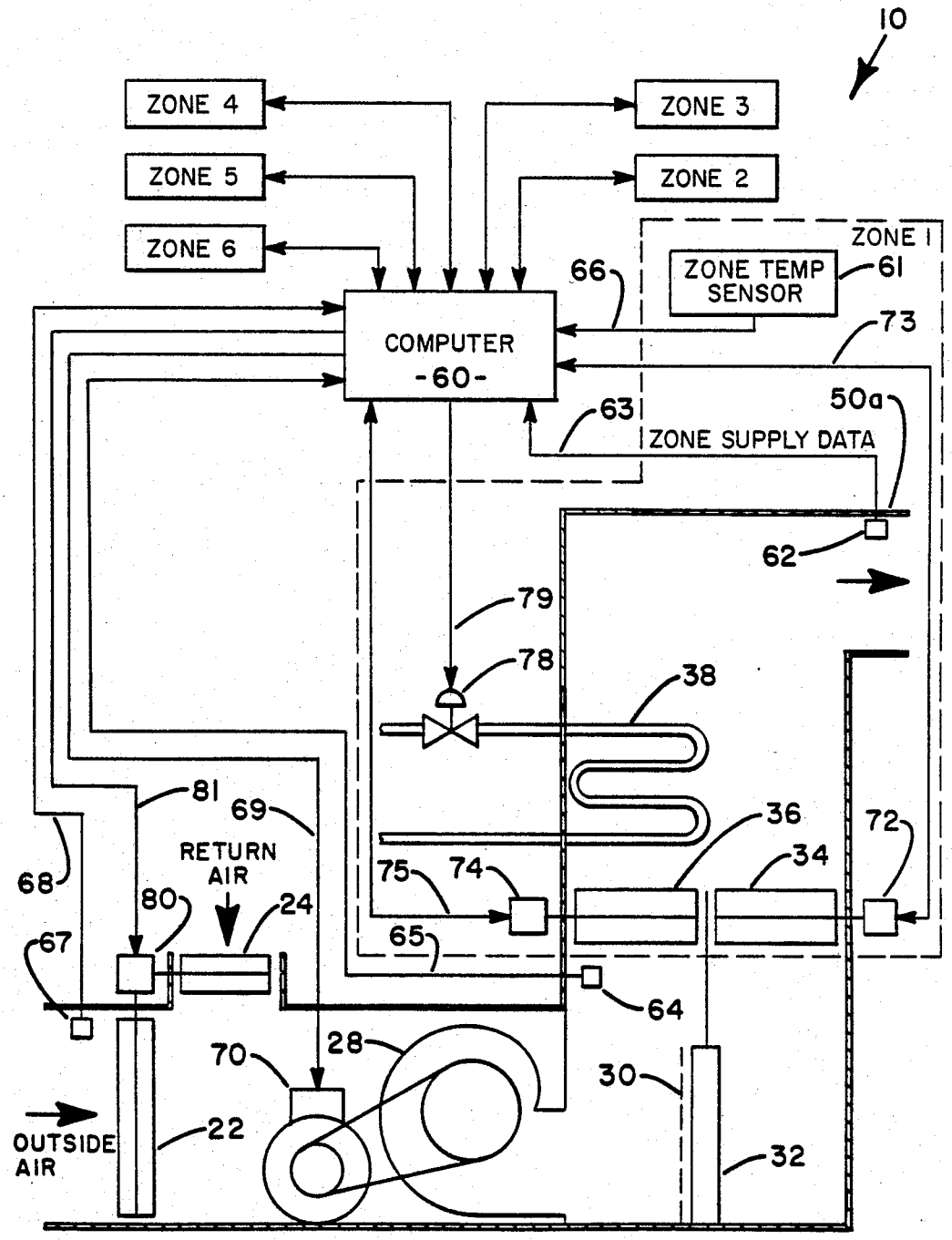
FIG. 5 is a schematic representation of the controls for a multizone system.

A schematic representation of the control system for a multizone system is illustrated in FIG. 5 wherein 60 generally designates a microprocessor or computer which would control the system 50 of FIG. 4. Computer 60 receives zone data from each zone and system data from the fan section and controls the inlet air, and the dampers and heating coils in each zone responsive thereto. Referring specifically to zone 1 which is representative of all of the zones, supply velocity data for zone 1 is supplied as an analog input to computer 60 by zone supply sensor 62 via line 63 and this data represents the volume of the air supplied to the zone. Similarly, fan discharge temperature sensor 64 furnishes air supply temperature data as an analog input to computer 60 via line 65. A zone temperature sensor 61 supplies zone temperature data as an analog input to computer 60 via line 66. Responsive to the velocity sensed in each zone by sensors 62, and the temperature data sensed by zone temperature sensors 61, computer 60 controls fan motor 70 via line 69 and thereby causes fan 28 to speed up or slow down, as required by all the zones. Additionally, outside air temperature sensor 67 furnishes ambient temperature data to computer 60 via line 68 so that the unit can be run on the economizer cycle.

Each of the zones is controlled through dampers 34 and 36 which are respectively independently positioned by motors 72, and 74 which are controlled by computer 60 via lines 73 and 75, respectively. As best shown in FIGS. 3A and B, the dampers 34 and 36 are controlled such that only neutral air is supplied over a temperature range to prevent stagnation as well as to prevent cycling and simultaneous heating and cooling in a zone. For example, heating can take place when the zone temperature is Thsp+2, or less, and cooling can take place when the zone temperature is Tcsp−3, or more, but between Thsp+2 and Tcsp−3 only neutral air is supplied and at a minimum quantity, e.g. 25%, to prevent stagnation.

In the cooling mode, initially all air is supplied to the zone through cooling zone damper 34. Damper 34 is regulated by motor 72 under the control of computer 60 in response to the zone temperature data supplied via line 66. The computer 60 acts to maintain the cooling set point temperature of the zone. At low cooling loads, where the cool air quantity required would fall below the minimum air quantity for good air distribution and fresh air requirements, upon hitting the minimum flow, the cooling zone damper 34 is automatically driven to a closed position. Minimum air is maintained by the controlled opening of neutral air damper 36 under the control of computer 60 which senses the reduction in the air volume due to the closing movement of damper 34 via the zone supply sensor 62. The maintenance of minimum air quantity between the cooling and heating modes eliminates the dead band air stagnation problem experienced with some VAV systems. Also, the automatic closing of damper 34 when minimum air flow is reached guarantees that cool and warm air cannot be mixed.

The automatic changeover to the heating mode takes place at the heating set point. All air is passing through the neutral air damper 36 at changeover since the cooling zone damper 34 would be automatically closed in passing through an adjustable range of 71°–74° F., for example, and only minimum neutral air would be supplied. The air quantity in the heating mode ranges between minimum air and up to 100% of the cooling air quantity. Neutral air damper 36 of each zone is modulated under the control of computer 60 to balance the zone heating load. The zone load for each zone is additionally balanced by a two position valve 78 which is controlled by computer 60 via line 79 and controls the flow of hot water to the zone heating coils 38. Alternatively, staged electric heating coils (not illustrated) can be controlled.

The system can be operated in an economizer cycle by controlling linked mixing box dampers 22 and 24 via a discrete output supplied by computer 60 via line 81 to motor 80 to supply, respectively, outside air, or a mixture of return and outside air. When the outside air temperature, as sensed by sensor 67, is above the cooling set point, supply air consists of return air and a minimum amount of outside air for the fresh air makeup requirement. When the outside air temperature falls below the space cooling set point by an adjustable margin, supply air consists of all outside air and if the outside air temperature is below 60° F., for example, mechanical cooling is disabled but all cooling air passes through cooling air zone damper 34 for control. As outside temperature falls, mixing box dampers 22 and 24 are modulated to maintain a fan discharge temperature of 60° F. The cooling zone damper 34 is modulated to maintain the space temperature set point. Alternatively, enthalpy, rather than outside air temperature, may be used in controlling the economizer cycle.

Figure 6:
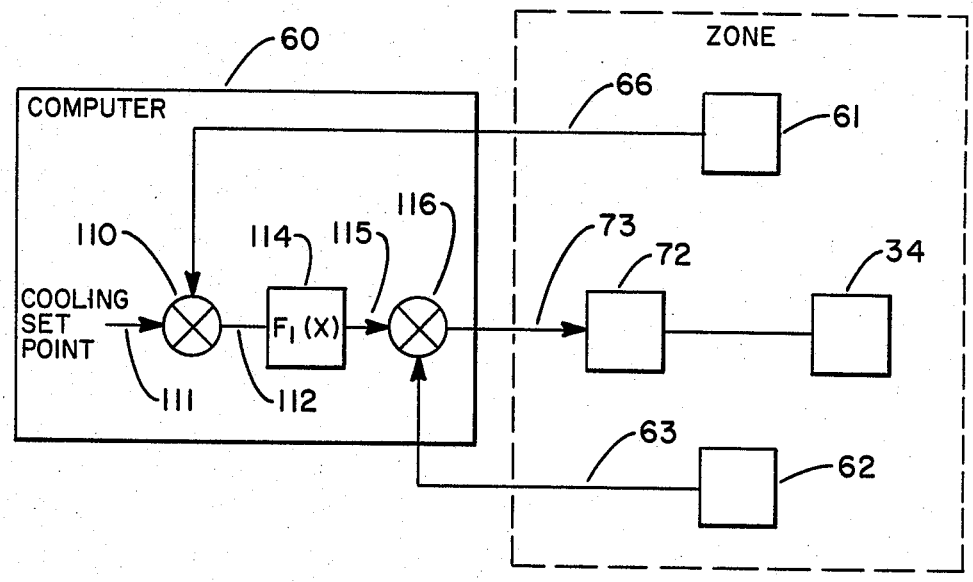
FIG. 6 is a schematic representation of the cooling damper control loop.

Referring now to FIGS. 5 and 6, for each zone in the cooling mode, a summing circuit 110 receives a first input signal via line 111 which represents the zone cooling set point. The cooling set point is adjustable to fit unit requirements and is a part of the computer software. A second signal representing the zone temperature is supplied to summing circuit 110 by zone temperature sensor 61 via line 66.

Responsive to the cooling set point signal and the sensed zone temperature, the summing circuit 110 supplies an output signal representing the current zone demand via line 112 to function generator 114. The function generator 114 processes the signal supplied by summing circuit 110 and produces an output signal representing the flow set point which is supplied as a first input to summing circuit 116 via line 115. A second signal representing the velocity and volume flow to the zone is supplied to summing circuit 116 by sensor 62 via line 63. Responsive to the flow set point and the sensed zone supply data, summing circuit 116 supplies an output signal via line 73 to motor or actuator 72 for repositioning damper 34, if required. Because zone temperature data and zone supply data are being constantly supplied to computer 60 via sensors 61 and 62, respectively, a control loop exists to reposition damper 34 with changing conditions.

Figure 7:
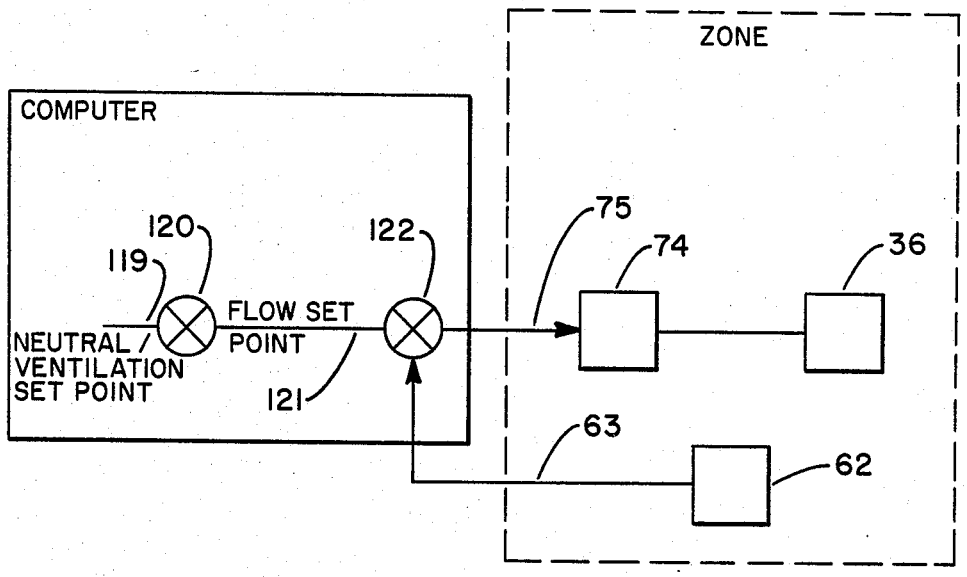
FIG. 7 is a schematic representation of neutral damper control loop.

For each zone in the neutral/ventilating operational mode, the loop of FIG. 7 is activated by the space temperature sensor 61 but the flow is constant at the minimum flow and is not reset by the zone temperature sensor 61 since temperature requirements are satisfied in the zone. The summing circuit 120 receives a neutral/ventilation set point signal via line 119 and supplies a signal representative of the flow set point via line 121 to summing circuit 122 as a first input. A second signal representing the velocity and volume flow to the zone is supplied to summing circuit 122 by sensor 62 via line 63. Responsive to the flow set point and the sensed zone supply data, summing circuit 122 supplies an output signal via line 75 to motor or actuator 74 for repositioning damper 36, if required.

Figure 8:
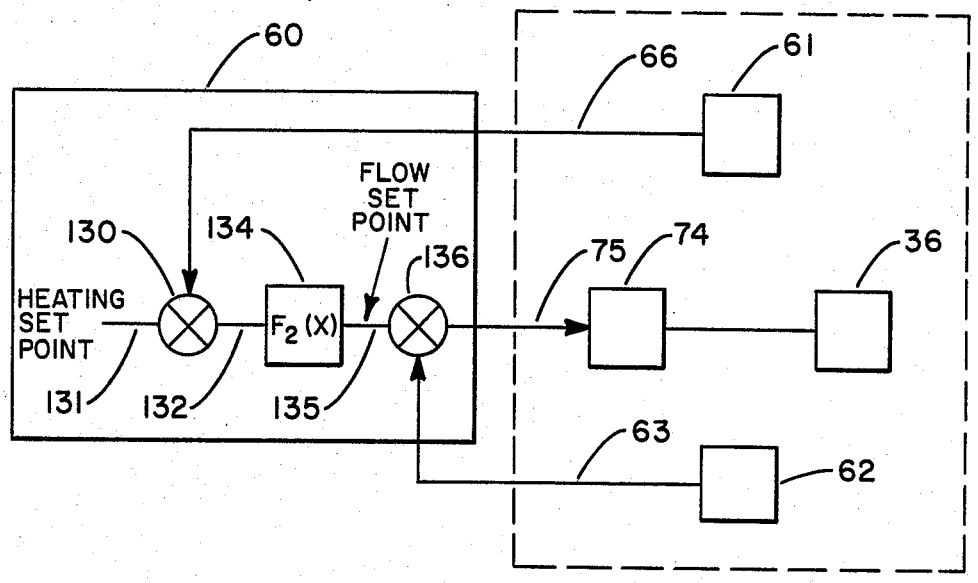
FIG. 8 is a schematic representation of the heating damper control loop.
Figure 9:
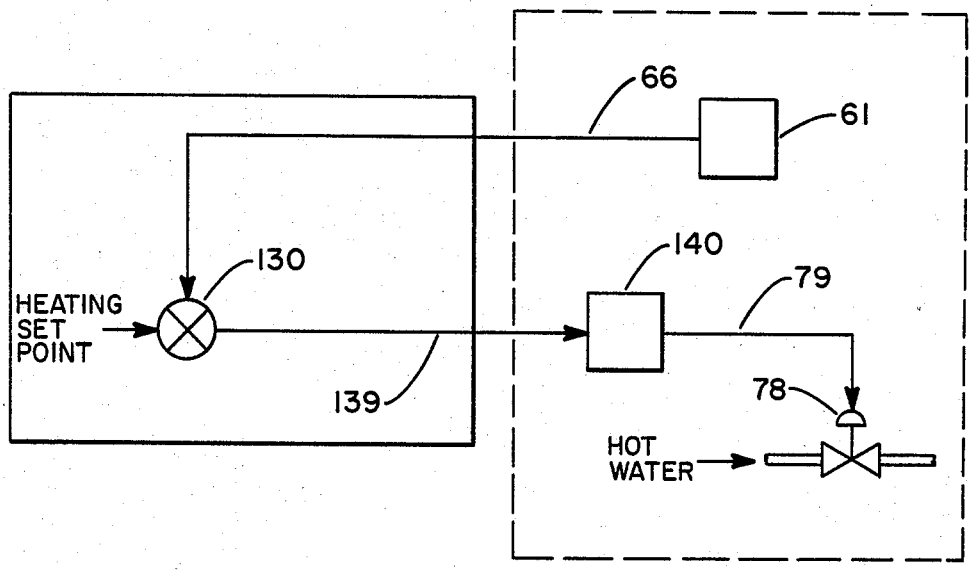
FIG. 9 is a schematic representation of the heating coil control loop.

Since the neutral and heating dampers are the same, the heating damper control loop and the heating coil control loop are both necessary for control. Referring now to FIG. 8, for each zone in the heating mode, a summing circuit 130 receives a first input signal via line 131 which represents the zone heating set point. The heating set point is adjustable to fit design requirements and is part of the computer software. A second signal representing the zone temperature is supplied to summing circuit 130 by zone temperature sensor 61 via line 66. Responsive to the heating set point signal and the sensed zone temperature, the summing circuit 130 supplies an output signal representing the current zone demand via line 132 to function generator 134. The function generator 134 processes the signal supplied by summing circuit 130 and produces an output signal representing the flow set point which is supplied as a first input to summing circuit 136 via line 135. A second signal representing the velocity and volume flow to the zone is supplied to summing circuit 136 by sensor 62 via line 63. Responsive to the flow set point and the sensed zone supply data, summing circuit 136 supplies an output signal via line 75 to motor or actuator 74 for repositioning damper 36, if required. Additionally, as shown in FIG. 9, the source of heat must be activated to convert damper 36 from the neutral mode to the heating mode. Responsive to the heating set point signal and the sensed zone temperature signal supplied by zone sensor 61, summing circuit 130 additionally, supplies an output signal via line 139 to controller 140 to activate and/or regulate the heat supply which is illustrated in the form of a hot water coil controlled through solenoid valve 78. Typically the heating coils (hot water or electric heat) are operated on a stepwise basis in conjunction with controlling the delivered air.

Figure 10:
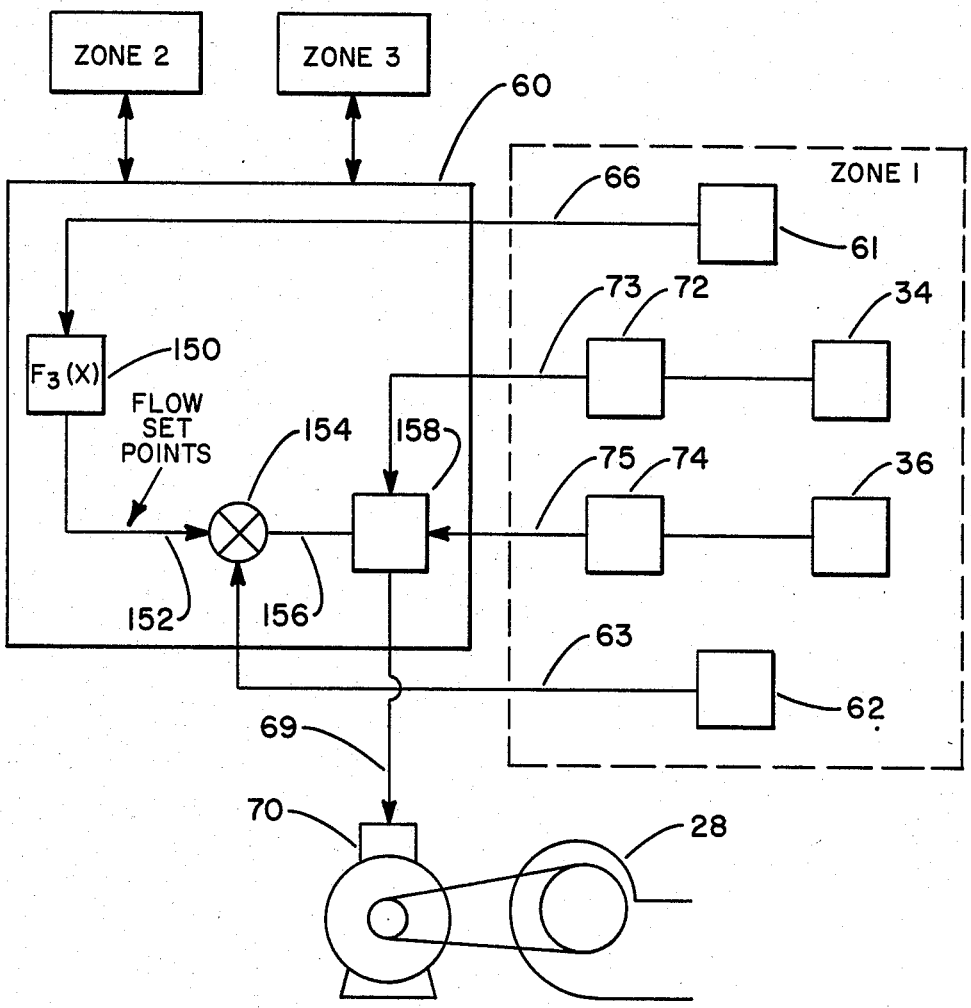
FIG. 10 is a schematic representation of the fan speed control loop.

As noted above, the present invention is operated to satisfy the temperature requirements of each zone and to maintain a minimum air flow in those zones with satisfied temperature requirements. Additionally, the speed of the fan is regulated so as to provide sufficient air flow at minimum fan speed. This is done by slowing the fan down to cause the dampers to be opened wider to achieve sufficient flow. The opening of the dampers reduces the flow resistance and the fan speed is adjusted so that at least one damper for one of the zones is fully open and the zone temperature requirements met. Referring now to FIG. 10, it will be noted that each zone in the system supplies information to computer 60 indicative of the zone temperature, zone supply conditions and damper positions. Since changes at the variable volume multizone unit 10 take time to reach the zones, the zones are individually polled in a cyclic sequence and only the connections to a single zone, designated zone 1, are illustrated in detail and only three of the zones in all. Zone temperature sensor 61 supplies zone temperature data to function generator 150 via line 66. Function generator 150 generates a flow set point for the zone and supplies this signal via line 152 as a first input to summing circuit 154. A second signal representing the velocity and volume flow to the zone is supplied to summing circuit 154 by sensor 62 via line 63. The output of summing circuit 154 which represents the zone supply conditions is supplied to controller 158 via line 156 as a first input. A position feedback signal is supplied to controller 158 by actuator or motor 72 via line 73 and/or actuator or motor 74 via line 75 as second and third inputs to controller 158. If in polling all of the zones one of the dampers is fully open and the zone flow and/or temperature requirements are not met, controller 158 sends a signal via line 69 to fan motor 70 causing it to speed up. If in polling all of the zones at least one of the dampers is fully open and all of the zone flow and temperature requirements are met no changes are made. If in polling all of the zones the flow and temperature requirements are met but no damper is fully open, controller 158 sends a signal via line 69 to motor 70 causing it to slow down. A typical speed up or slow down of motor speed is 3–5% and the polling would take place every few minutes, typically 5 to 10.

Figure 11:
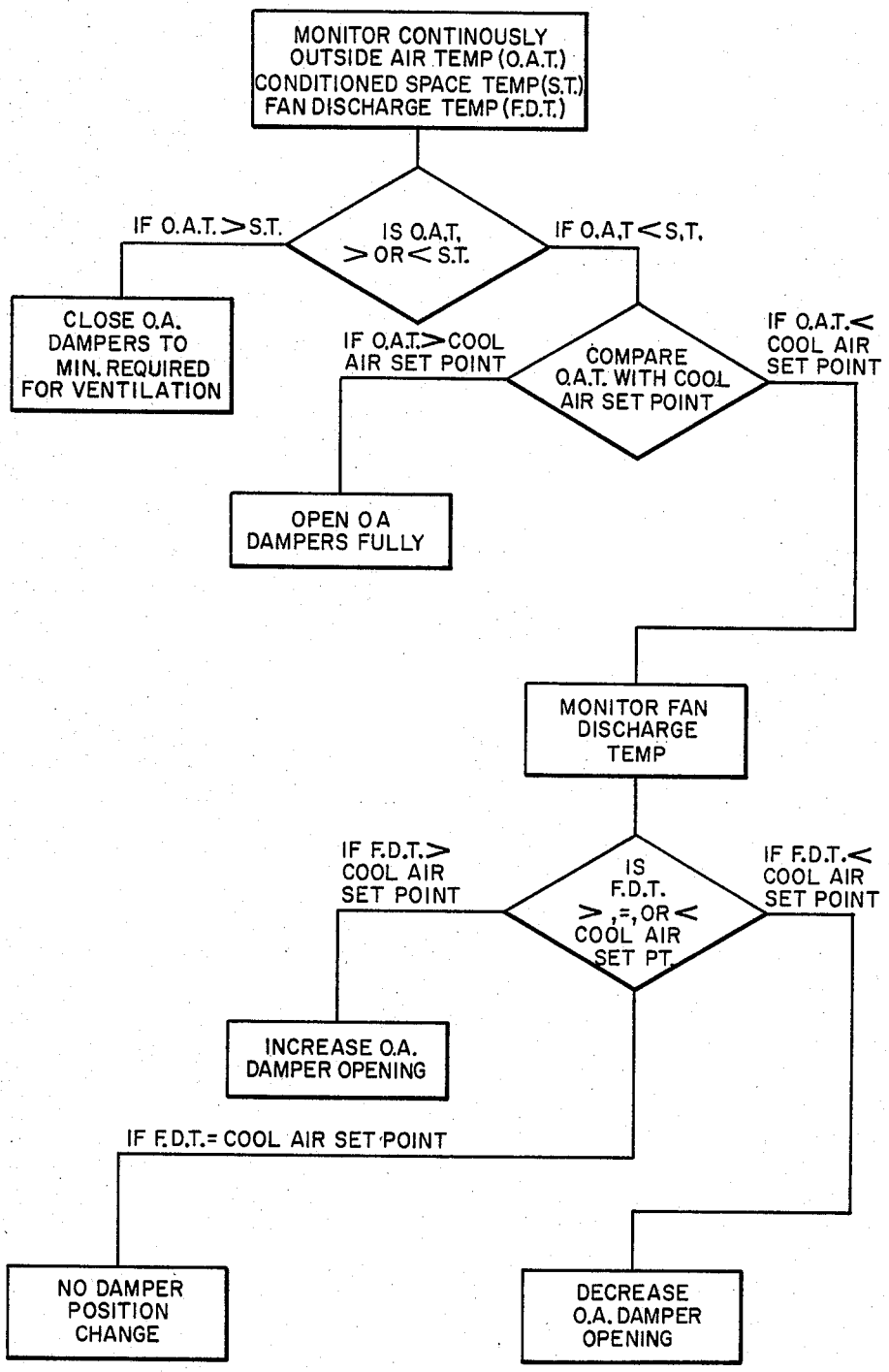
FIG. 11 is a flow diagram for the economizer cycle.

The system can be operated in an economizer cycle in which the outside air quantity brought into the building is controlled to achieve minimum energy usage for cooling and to permit shut down of the refrigeration machine when the outside air source will provide the supply air temperature required for cooling. Referring to FIG. 5, the controls for the economizer loop consist basically of outside air temperature sensor 67, fan discharge temperature sensor 64, zone temperature sensor 61, a controller which is a part of computer 60 and damper actuator 80. The controller has inputs for the three temperature sensors 67, 64 and 61 and an adjustable temperature set point which represents cooling air temperature requirement. The controller output operates the damper actuator 80 to modulate the damper 22 from full open to the closed position. Minimum fresh air requirements are obtained by a damper control stop during the occupied mode of the building to prevent full closure of outside air damper 22. In the unoccupied mode the stop is deactivated, allowing full closure of outside air damper 22. The stop is in the actuator 80. The flow chart for the economizer cycle is shown in FIG. 11.

The operation of the system takes place at two levels. Each zone is cyclically polled and the zone temperature compared with the zone set point and the appropriate adjustments made. Using the conditions of FIG. 3 as an example, if the zone temperature goes higher than Tcsp−3, the cooling damper control loop of FIG. 6 is activated. It should be noted, however, that the various temperature ranges shown in FIGS. 3A and B could be different for each zone if necessary or desirable. As explained above, the damper 34 is regulated in response to the sensed zone temperature and supply data as well as the cooling set point. In this loop the damper 34 is controlled independent of any of the other zones but the damper position is fed back for use in fan speed control. As the zone temperature passes through the area of overlap between cooling and neutral/ventilation, control passes between the neutral damper 36 and cooling damper 34 with the direction of control depending upon the direction of temperature change. Through this region damper 34 is positioned to supply sufficient cool air for zone temperature requirements and damper 36 is positioned to supply sufficient additional neutral air to meet the minimum air flow requirements, typically 25% of maximum flow. In going through a temperature drop through the area of overlap, the damper 34 is caused to close as described above; but in going through a temperature rise, the cooling damper is opened and cooling mode assumes control.

Over the minimum air ventilation temperature range, the neutral damper 36 is controlled as shown in FIG. 7 and described above with the damper 36 being positioned to maintain the minimum air flow requirements. When the temperature in the zone is below Thsp+2, the damper 36 is controlled as shown in FIG. 8 and described above. Additionally, the heating coil 38 is activated by controlling solenoid valve 78 as shown in FIG. 9 and described above. As noted, FIGS. 6–9 represent the polling of a single zone and its control in isolation. Without more, each of the zones could be satisfied but the fan power consumption could be too great. To minimize fan power consumption, the damper positions of each of the dampers in each of the zones is fed back to computer 60. This is illustrated in detail for one zone in FIG. 10. If in polling all of the zones no damper is fully open and the zones are satisfied, then fan motor 70 is slowed down. Similarly, if a zone damper is fully open and the zone unsatisfied, then fan motor 70 is speeded up. If at least one damper is fully open and the zone(s) satisfied, then fan speed is maintained. The fan speed is adjusted each polling cycle. To further minimize energy consumption, the system may be run on an economizer cycle as shown in the flow diagram of FIG. 11 and described above.

Figure 12:
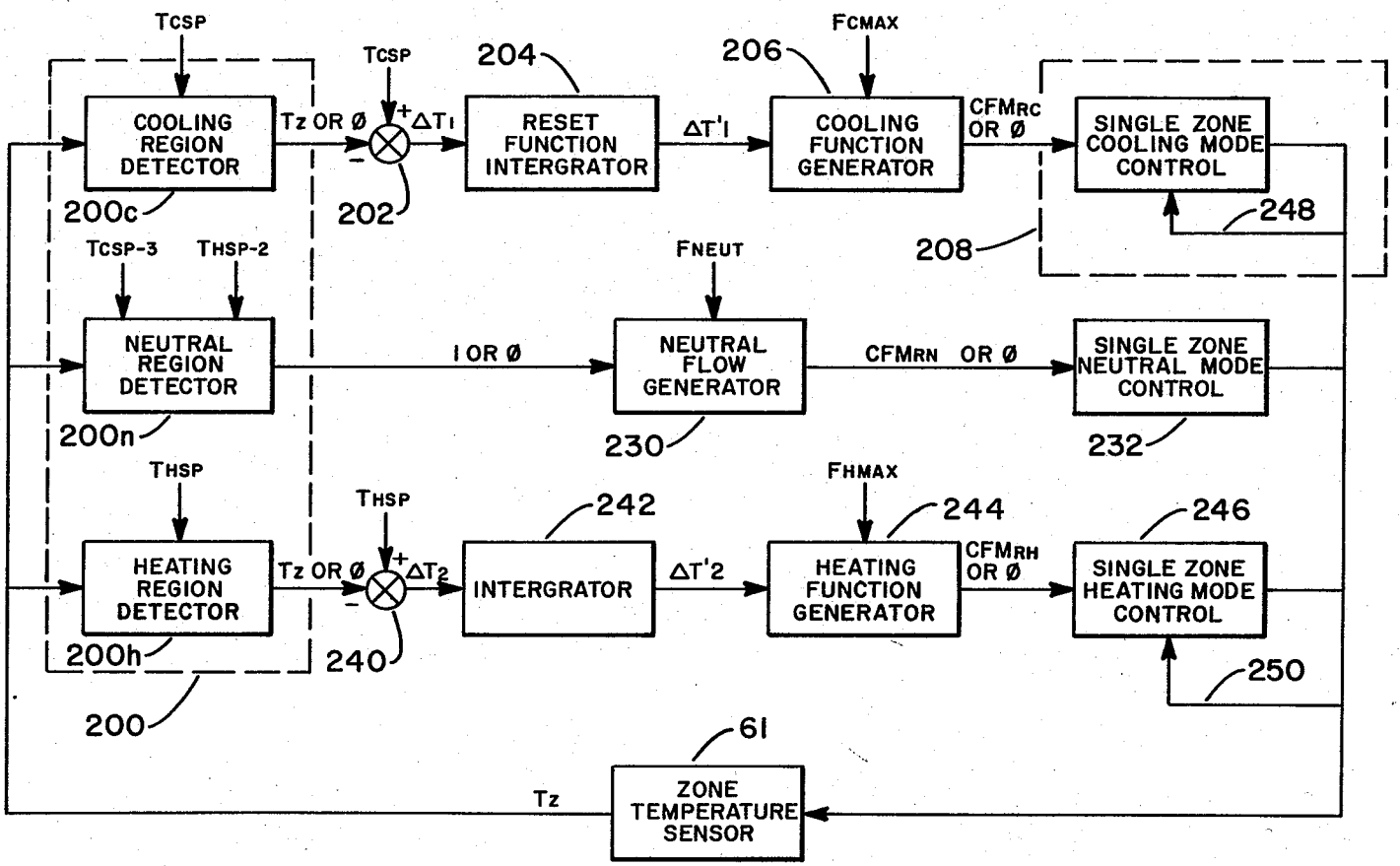
FIG. 12 is a schematic representation of the control of a single zone according to control theory or logic.
Figure 13:
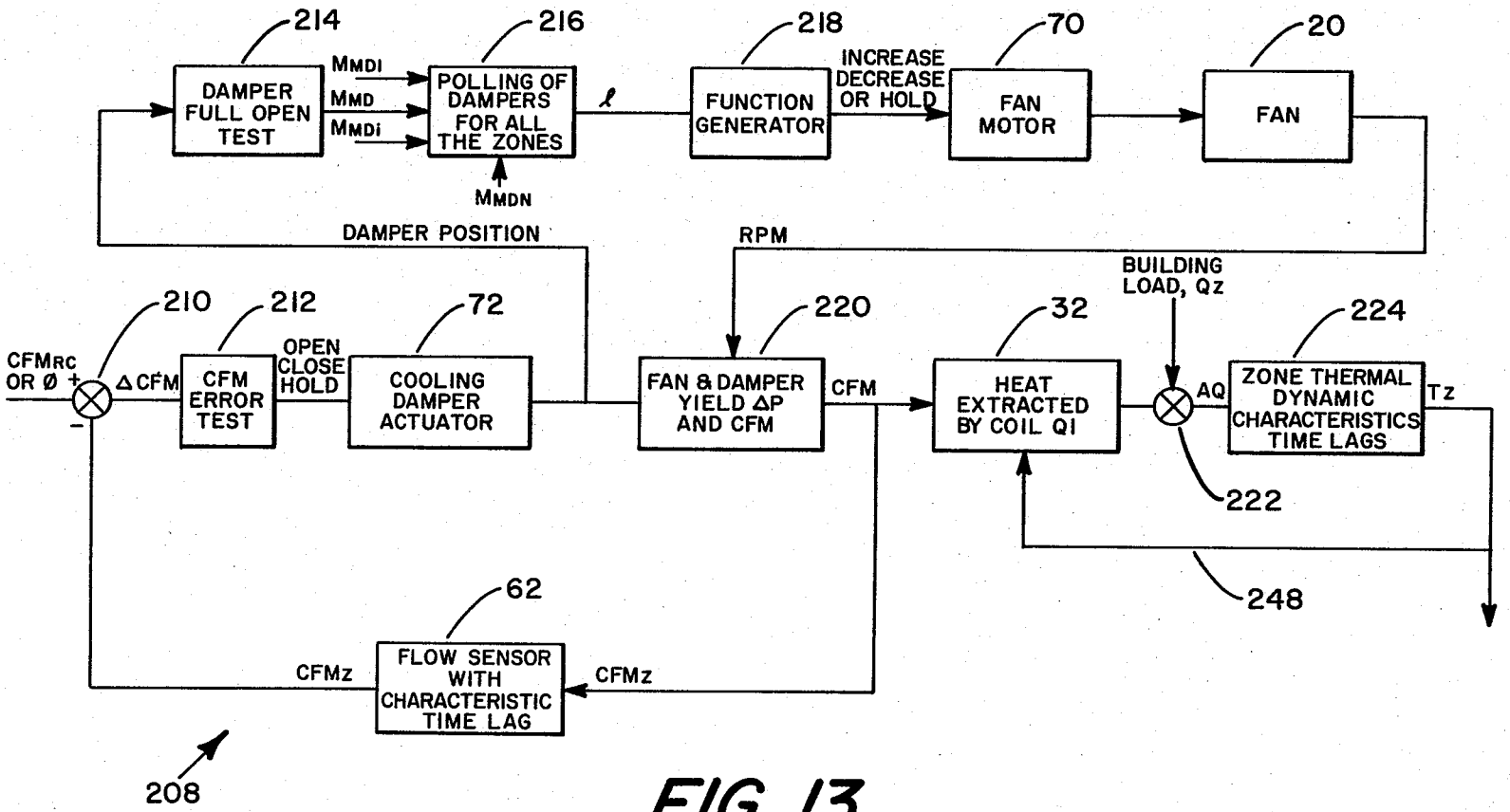
FIG. 13 is a detailed representation of a portion of the FIG. 12 controls.

The structure of FIGS. 6–10 for controlling a single zone is interrelated under control theory or logic as represented in FIGS. 12 and 13 which also include physical changes taking place in the system. A plot of the zone temperature, Tz, vs. air flow for a zone is illustrated in FIGS. 3A and B. Turning now to FIG. 12, the zone temperature in the zone is sensed by zone temperature sensor 61 and sensed zone temperature Tz is fed into temperature detector 200 which is functionally broken down into three separate areas. These areas are, respectively, the cooling region detector 200*c*, the neutral region detector 200*n* and the heating region detector 200*h*. The detectors 200*c*, *n*, and *h* determine which mode the zone is in. It should be noted that a single zone temperature sensor, 61, provides all of the temperature inputs for the zone in the heating, cooling and neutral modes without requiring a changeover. The cooling region detector 200*c* has cooling temperature set point, Tcsp, adjusted in. If, in the FIGS. 3A and B examples, Tz is greater than Tcsp−3, where 3 is the adjustable cooling range, then Tz will be fed through detector 200*c* and the control will operate in the cooling region. Otherwise, the output of detector 200*c* is Ø which takes away any active change in the loop. If the control is in the cooling region, the output Tz from detector 200*c* is fed as a negative first input to summing junction 202. Tcsp is supplied as a second input to summing junction 202. The difference between Tz and Tcsp, T1, is the temperature set point error and is supplied to integrator 204 which has the effect of adjusting the apparent set point for the purpose of holding the actual set point. Integrator 204 adds the T1 s and saves them to establish the "history" until an "event" takes place whereupon it zeros out or erases the error history. The establishing of a history prevents the making of big corrections due to sudden changes and permits zeroing in. An "event" can be a moving out of the cooling region or a change in Tcsp. The output of integrator 204, T'1, shifts the cooling region along the curve in FIG. 3 and is supplied as a first input to cooling function generator 206. T'1 adds stability so that the system does not overshoot by taking into account the building's thermal characteristics. Fcmax, the cooling maximum flow, which is input by the operator, is supplied as a second input to cooling function generator 206 which is a step function with a cfm input in it. The output of generator 206 is either CFMrc, a reference cooling cfm, or Ø depending upon whether or not the system is in the cooling mode and is supplied as an input to single cooling mode control 208 which is shown in greater detail in FIG. 13. CFMrc or Ø is supplied as a positive first input to summing junction 210. The zone flow, CFMz, sensed by flow sensor 62 with a characteristic time lag superimposed is supplied as a negative second input to summing junction 210. The output, CFM, of summing junction 210 represents the difference between the reference and sensed flows and is supplied to CFM error test 212 which determines whether the flow is excessive, insufficient or correct and responsive thereto closes, opens or holds the position of damper 34 by sending the appropriate signal to cooling damper actuator 72. The cooling damper actuator 72 makes the appropriate adjustment of damper 34 and the damper position is preferably supplied to damper full open test 214 which determines whether damper 34 is fully open or not and produces an output Mmd which is indicative thereof. The position outputs of the other damper in this zone as well as the dampers in the other zones indicated by Mmdl, Mmdi and Mmdn are polled by a polling circuit 216 which produces an output, 1, representing the poll outcome. This output is supplied to function generator 218 which produces an output based upon the poll outcome and is supplied as an increase, decrease or hold signal to fan motor or volume control 70 which makes an appropriate adjustment of the speed, rpm, of fan 20. The rpm of fan 20 and position of the damper 34 yield the change in pressure, P, and zone flow CFMz, as indicated by box 220 and the zone flow is sensed by flow sensor 62 as previously described. The zone flow is also supplied to coils 32 which responsive to zone flow CFMz and the zone temperature Tz extracts heat therefrom to produce a cooling effect Q1 which is supplied as a first input to summing function 222, the zone cooling load, Q2, is supplied as a second input to summing junction 222 whose output Q represents the resultant temperature change in the zone which produces zone thermal dynamic characterisitics and time lags represented by box 224 which results in Tz when the zone is in the cooling mode. Feedback loop 248 represents the effect on coil 32 from return air or zone temperature.

If, in the FIGS. 3A and B examples, Tz is greater than Thsp+2 and less than Tcsp−3 then the system will be in the neutral range and neutral region detector 200*n* of FIG. 12 will have an output of 1, otherwise it will be Ø. If the output of detector 200*n* is 1, it is supplied as an enabling input to neutral flow generator 230. Fneut which represents the operator set minimum neutral flow for ventilation purposes is supplied as an input to generator 230. Generator 230 has an output, CFMrn, the reference neutral flow. when in the neutral mode or otherwise Ø. The output CFMrn is supplied to single zone neutral mode control 232 which is identical to the single zone cooling mode control 208 of FIG. 13 except that: (1) cooling damper actuator 72 is replaced by neutral/heating damper actuator 74; (2) there is no addition or removal of heat as represented by coils 32; and (3) there is no need for Tz to be fed back as to coils 32.

If, in the FIGS. 3A and B examples, Tz is less than Thsp+2, where 2 is an adjustable heating range, then Tz will be fed through detector 200*h* and the control will operate in the heating region. Otherwise, the output of detector 200*h* is Ø which takes away any active change in the loop. If the control is in the heating region, the output Tz from detector 200*h* is fed as a negative first input to summing junction 240. Thsp is supplied as a second input to summing junction 240. The difference between Tz and Thsp, Tz, is the temperature set point error and is supplied to integrator 242 which has a reset function. Integrator 242 acts like integrator 204 and adds the Tzs and saves them until an "event" takes place whereupon it resets. An "event" can be the moving out of the heating range or a change in Thsp. The output of integrator 242, T'2, shifts the heating region along the curve in FIG. 3 and is supplied as a first input to heating junction generator 244. T'2 adds stability so that the system does not overshoot when making a correction by taking into account the building's thermal characteristics, Fhmax, the heating maximum flow, which is input by the operator, is supplied as a second input to heating function generator 244 which is a step function with a cfm input in it. The output of generator 244 is either CFMrh, a reference heating cfm, or Ø depending upon whether or not the system is in the heating mode and is supplied as an input to single zone heating mode control 246 which is identical to the single zone cooling mode control 208 of FIG. 13 except that: (1) cooling damper actuator 72 is replaced with heating damper actuator 74; and (2) rather than having heat extracted by coil 32, heat is added by coil 38 and feedback loop 250 represents the effect on coil 38 from return air or zone temperature.

Only one of the loops will be active except for the changeover between neutral and cooling. Whichever mode of operation is taking place, the zone temperature, Tz, is responsive thereto as is zone temperature sensor 61 which closes the loop. Flow sensor 62 provides the flow information necessary to provide the correct flow as during changeover between neutral and cooling.

From the foregoing, it is clear that flow and temperature data as well as demand is continually monitored for each zone as well as the total system. To summarize the operation, the flow is measured and compared to the flow set point on a zone basis. If the flow is not satisfied in any zone, the dampers are opened to obtain the flow required. If no dampers are wide open and dampers are opening to obtain more flow no fan adjustment takes place. When a situation exists where one damper is wide open and the flow is not satisfied, then the fan speed will be increased until flow is satisfied. Where the flow is satisfied but no dampers are wide open, fan speed is decreased until one or more dampers are wide open. Fan speed thus increases where there is a wide open damper and unsatisfied flow until such time as the flow is satisfied and fan speed decreases where flow is satisfied and no dampers are wide open until such time as one or more dampers is wide open.

Although a preferred embodiment of the preseht invention has been illustrated and described, other changes will occur to those skilled in the art. It is therefore intended that the scope of the present invention is to be limited only by the scope of the appended claims.

What is claimed is:

1. A method for operating a variable volume multizone system having a variable volume air supply and a plurality of zones with each of said plurality of zones having a first damper for controlling the flow of air into the zone from the variable volume air supply through a cooling coil, a second damper for controlling the flow of air into the zone from the variable volume air supply through a heating coil and means for heating the heating coil including the steps of:

sensing the temperature in each zone;

if the temperature in any zone is above a first adjustable set point for the zone, supplying air to the zone through the cooling coil only and adjusting the position of the first damper to regulate the flow to the zone;

if the temperature in any zone is below a second adjustable set point for the zone, supplying air to the zone through the heating coil only, heating the heating coil and adjusting the position of the second damper to regulate the flow to the zone; and if the temperature in any zone is below said first adjustable set point and above said second adjustable set point supplying air to the zone through the unheated heating coil and adjusting the position of said second damper so as to maintain an adjustable minimum flow into the zone.

2. The method of claim 1 further including the step of monitoring the position of each of the dampers and reducing the variable volume air supply if at least one damper is not fully open.

3. The method of claim 2 wherein the step of monitoring the position of each of the dampers is done cyclically.

4. The method of claim 1 further including the step of cyclically monitoring the position of each of the dampers and zone demand and regulating the speed of the variable volume air supply so as to satisfy the demands of each zone at the lowest suitable fan power.

5. The method of claim 1 wherein the flow of air through the heating coil is at a constant volume when the heating coil is being heated.

6. The method of claim 1 wherein the flow of air through the heating coil is at a variable volume up to the maximum flow.

7. The method of claim 1 herewith including steps of:

supplying outside air in amounts ranging from the minimum requirement for ventilation up to 100% with any deficiency make up with return air in response to the temperature of the outside air.

* * * * *